US008344839B2

(12) United States Patent
Faccin

(10) Patent No.: US 8,344,839 B2
(45) Date of Patent: Jan. 1, 2013

(54) MULTI-CHAMBER TRANSFORMER

(75) Inventor: Marco Faccin, Caerano San Marco (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 293 days.

(21) Appl. No.: 12/085,992

(22) PCT Filed: Nov. 28, 2006

(86) PCT No.: PCT/EP2006/068981

§ 371 (c)(1),
(2), (4) Date: Jun. 4, 2008

(87) PCT Pub. No.: WO2007/065811

PCT Pub. Date: Jun. 14, 2007

(65) Prior Publication Data

US 2009/0295530 A1 Dec. 3, 2009

(30) Foreign Application Priority Data

Dec. 6, 2005 (EP) ..... 05425867

(51) Int. Cl.
*H01F 27/02* (2006.01)
*H01F 27/28* (2006.01)
*H01F 27/30* (2006.01)

(52) U.S. Cl. ..... 336/90; 336/82; 336/83; 336/180; 336/196; 336/198; 336/220

(58) Field of Classification Search ..... 336/82, 336/83, 90, 170, 180, 195, 196, 198, 208
See application file for complete search history.

(56) References Cited

U.S. PATENT DOCUMENTS

| | | | | |
|---|---|---|---|---|
| 3,909,761 | A | 9/1975 | Miles | |
| 5,534,839 | A * | 7/1996 | Mackin et al. | 336/192 |
| 5,635,891 | A * | 6/1997 | Miyoshi et al. | 336/90 |
| 5,783,982 | A * | 7/1998 | Lecheler | 336/192 |
| 2002/0017975 | A1 | 2/2002 | Chiang et al. | |
| 2004/0178873 | A1 | 9/2004 | Kohno | |

FOREIGN PATENT DOCUMENTS

| | | | |
|---|---|---|---|
| DE | 3241408 | A1 * | 5/1984 |
| DE | 91 04 254 | U1 | 7/1991 |
| EP | 1657728 | A1 * | 5/2006 |
| GB | 2 213 651 | A | 8/1989 |

OTHER PUBLICATIONS

DE 9104254 translation.*

* cited by examiner

*Primary Examiner* — Mohamad Musleh
*Assistant Examiner* — Tsz Chan

(57) ABSTRACT

A transformer includes: —a plurality of windings (P, S1, S2) wound on a coil former (100), preferably in the form of a one-piece coil former, —a pair of first insulating flanges (106) separating a first winding (P) from a pair of second windings (S1, S2), —a pair of second insulating flanges (104) defining together with the first insulating flanges (106) two winding spaces for the second windings (S1, S2). The ends (P1, P2) of the wire of the first winding (P) extend across the winding spaces for the second windings (S1, S2). Insulating walls (208) are provided extending between the ends (P1, P2) of the wire of the first winding (P) and the second windings (S1, S2) to provide insulation therebetween.

16 Claims, 5 Drawing Sheets

MULTI-CHAMBER TRANSFORMER

FIELD OF THE INVENTION

Figure 1:
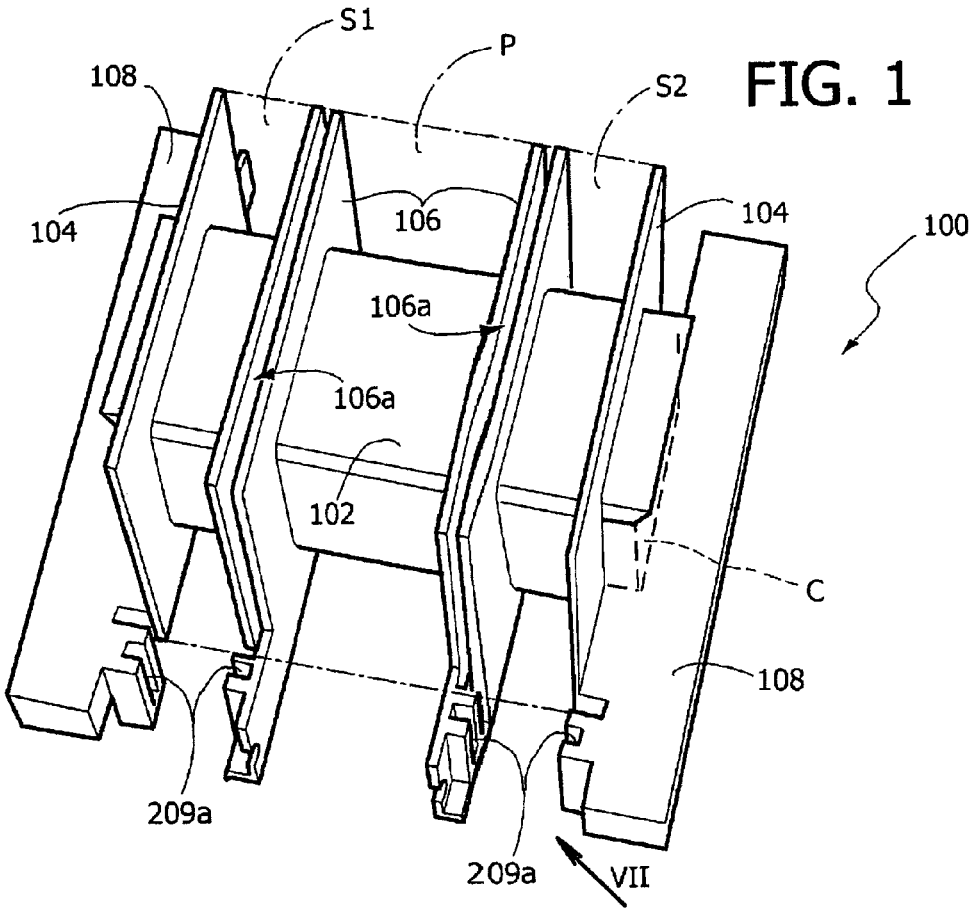

The present invention relates to (electrical) transformers.

DESCRIPTION OF THE RELATED ART

Transformers are used in several areas e.g. in power supply units for halogen lamps, wherein an input line voltage (e.g. the typical 220-240 volt mains voltage of most European countries, while 100-120 volts are typical values for American countries) is transformed into an output voltage of 6, 12 or 24 volts, which must be isolated from the mains according to specific safety standards for this sort of device.

Transformers having symmetric three-chamber winding structures offer a number of distinct advantages over transformers having conventional two-chamber windings.

These advantages include, e.g., a significant reduction of proximity losses within the windings, a flux equilibrium within the core (which nulls the magnetic field in the outer leg(s) of the core and thus reduces the core losses), a higher quality factor of the leakage inductance (up to 70) due to the symmetrical field distribution which enables such a transformer to be used also as real resonance inductor for soft-switching circuits, and finally a reduced electromagnetic noise emission.

Thus, when using three windings i.e. three coils, the same power can be transferred by using a core of smaller size.

European Patent Application No. 05425091.5, which forms part of the prior art under the provisions of Art. 54.3 EPC, discloses a transformer including a plurality of windings wound on an insulating bobbin, which in turn includes a plurality of coil formers each having at least one respective winding wound thereon. Each coil former includes two separating end walls providing insulation of the respective winding, and at least one of the end walls of the coil formers has a protruding portion extending in correspondence with a neighbouring coil former. The protruding portion in question may include a wall extension at least partly covering the respective winding provided in the neighbouring coil former, and/or a pin stand.

Such a prior art transformer, having a three-winding configuration is thus formed by three separated "discs", which together form the coil former, plus a cap.

Manufacturing such a transformer structure thus requires:

- four different moulding tools,
- three separated operations of winding of the coil wires on (around) each individual disc,
- subsequently putting together the three disc assemblies thus formed, and
- final insertion into the protective cap of the transformer plus insertion of the ferrite core and the soldering of the wires, whatever the order of performing these operations may be.

OBJECT AND SUMMARY OF THE INVENTION

Despite the inherent advantages related to the prior art arrangement referred to in the foregoing, the applicant have determined that room still exists for further improvement primarily related to:

- savings in terms of moulding tools and assembly process,
- even closer compliance with standards that impose minimum distances between the primary (central winding) and secondary side (the two lateral windings), this being particularly the case in point when the component is used in SELV (Safety Extra Low Voltage) applications where specific insulation requirements are to be met.

The object of the present invention is to provide such an improvement. According to the present invention, that object is achieved by means of a transformer having the features set forth in the claims that follow. The claims are an integral part of the disclosure of the invention as provided herein.

A preferred embodiment of the arrangement described herein is thus a multi-chamber transformer including:

- a plurality of windings wound on a coil former,
- at least one first insulating flange separating a first winding of said plurality of windings from at least one second winding of said plurality of windings,
- at least one second insulating flange defining together with said at least one first insulating flange a winding space for said at least one second winding, wherein said first winding has at least one end extending across said winding space for said at least one second winding, and
- an insulating wall extending between said at least one end of said first winding and said at least one second winding to provide insulation therebetween.

Such a preferred embodiment of the arrangement described herein leads to an optimization in the construction of e.g. a "three chamber" transformer of the type considered in the foregoing, wherein the primary winding is wound in the central part of the coil former while the secondary winding is comprised of two windings arranged laterally of the primary winding. The two secondary, lateral windings are connected in series or in parallel depending on the requirements of the circuit.

In such a preferred embodiment the transformer is essentially comprised of two basic elements, namely a coil former with three winding chambers for the primary winding and the two secondary windings, respectively, plus a protective cap.

BRIEF DESCRIPTION OF THE ANNEXED DRAWINGS

Figure 2:
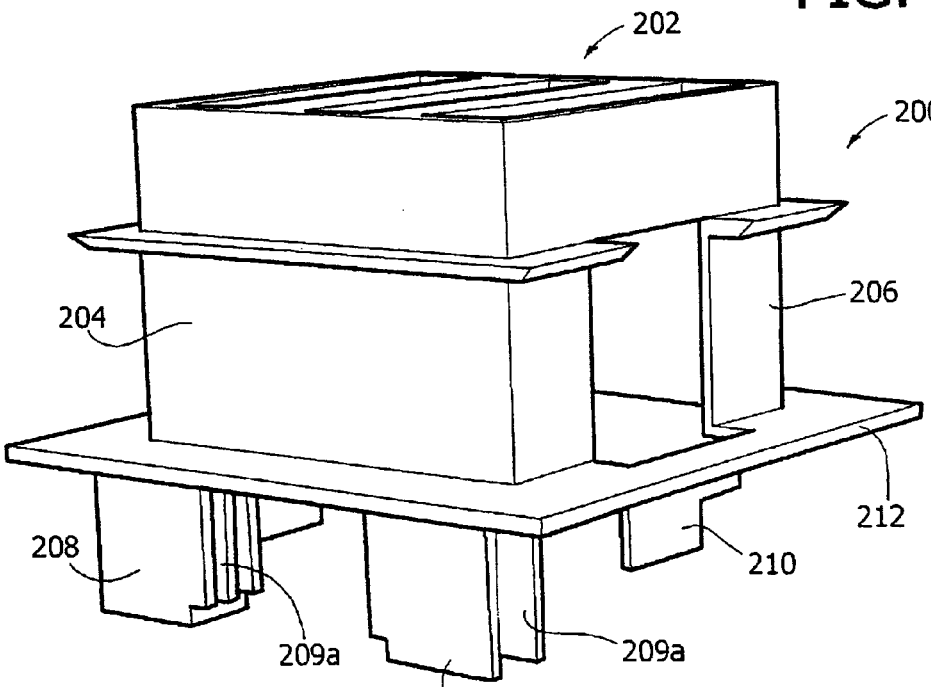
Figure 3:
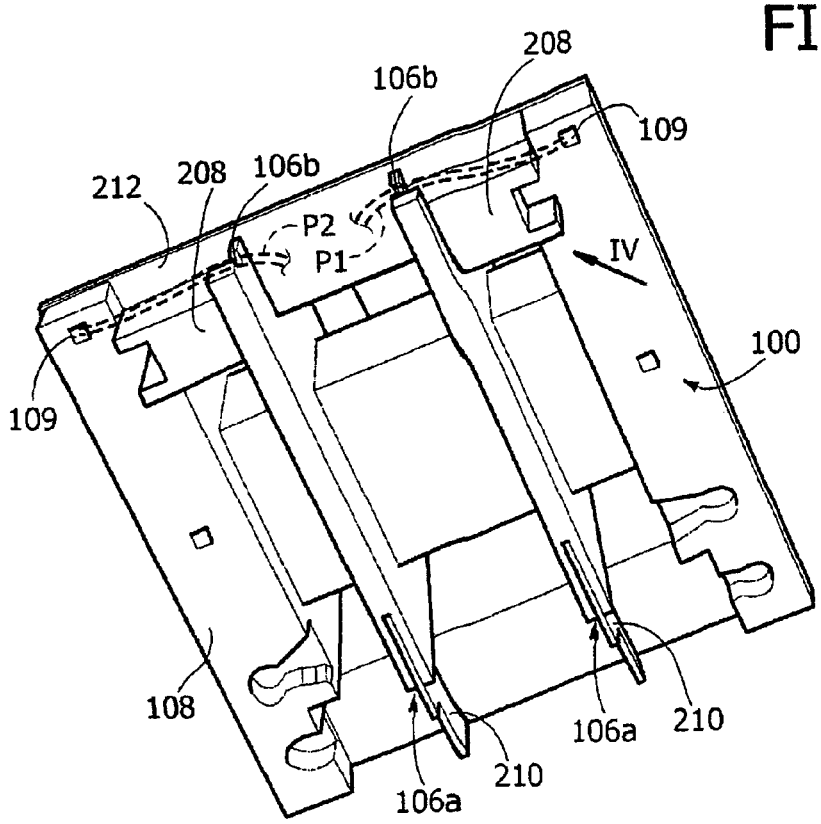
Figure 4:
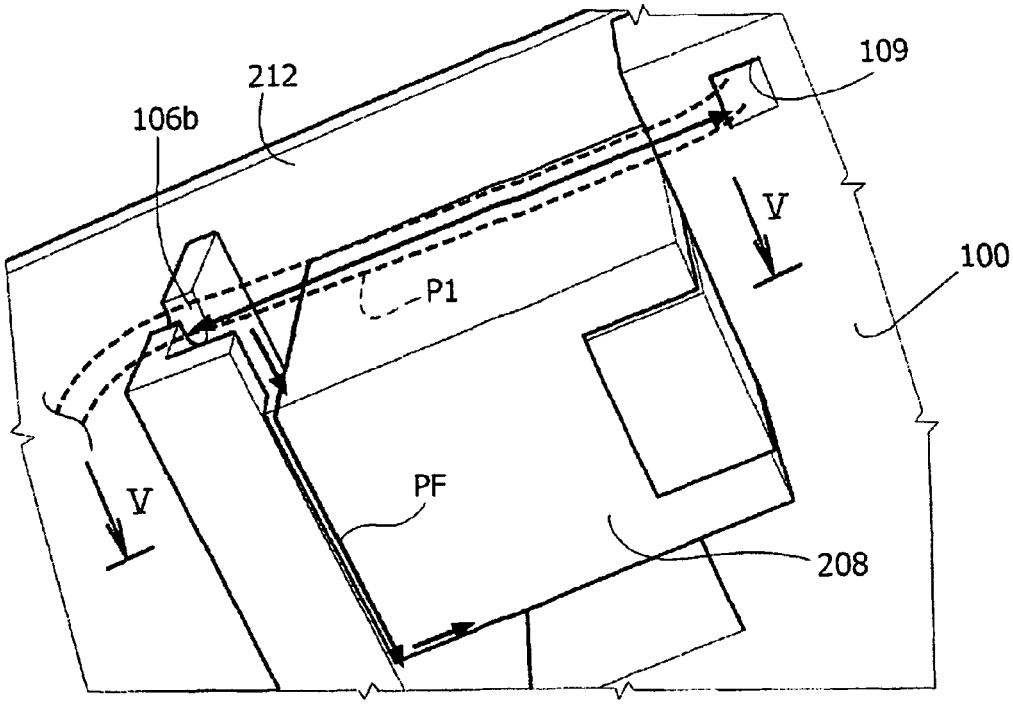
Figure 5:
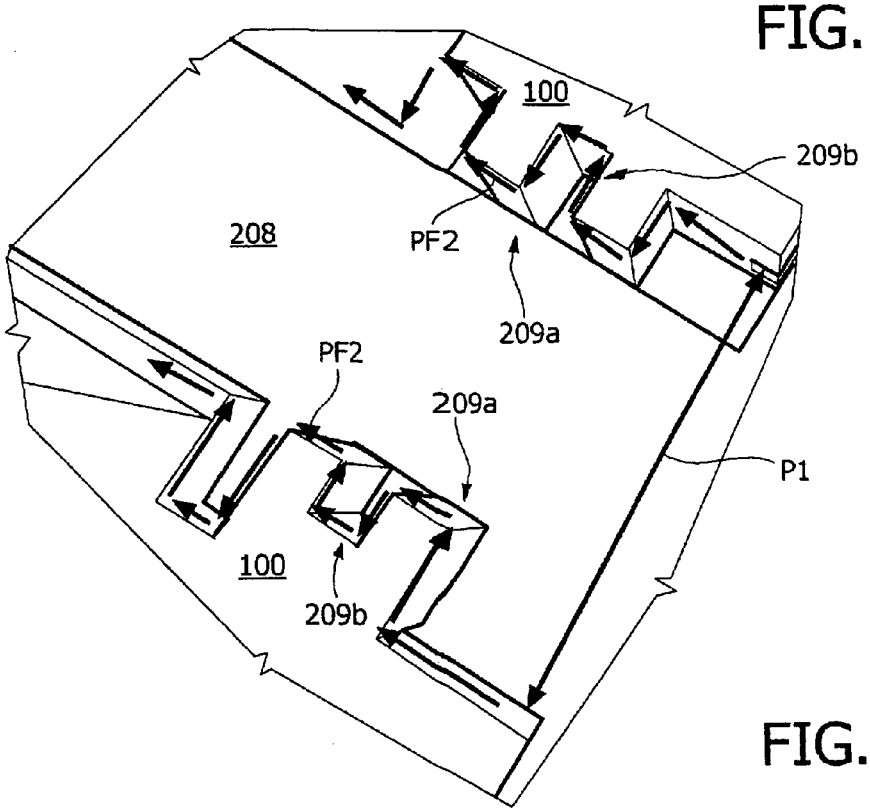
Figure 6:
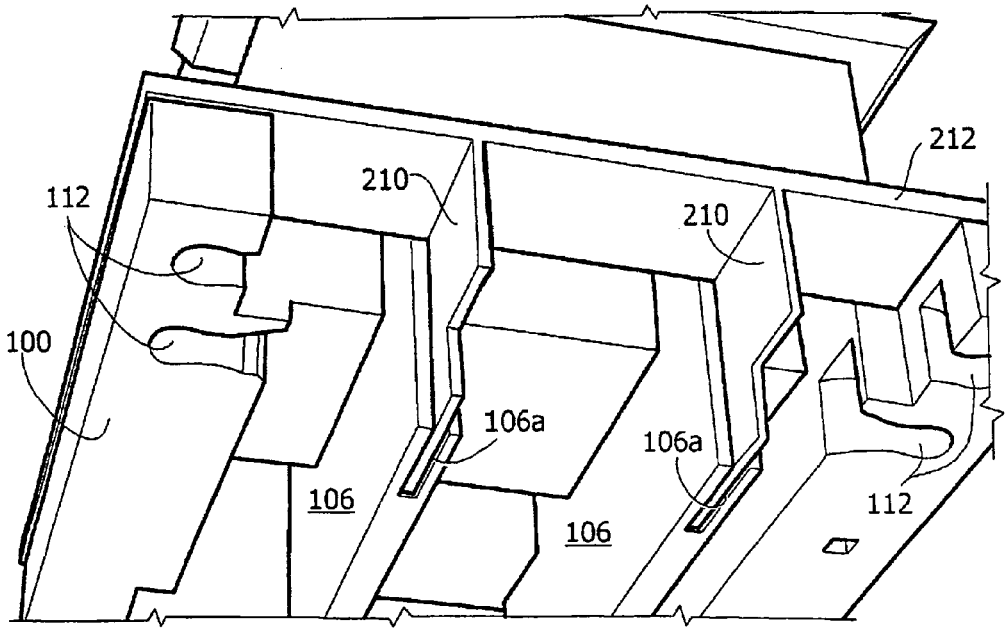
Figure 7:
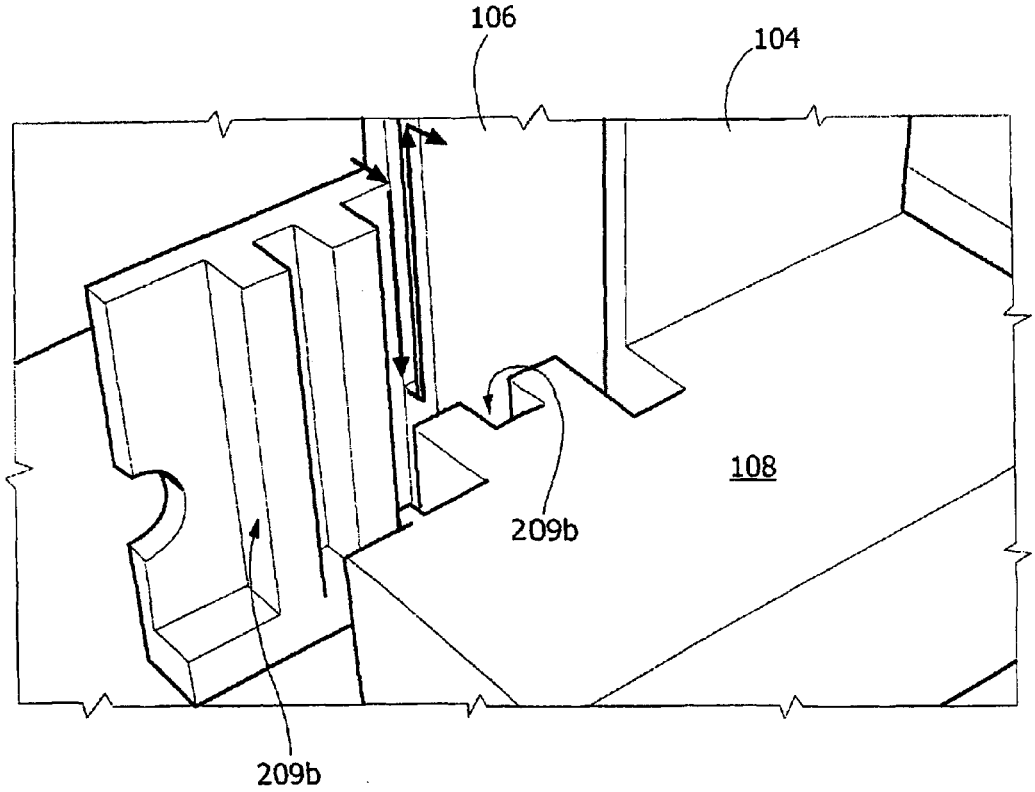

The invention will now be described, by way of example only, by referring to the enclosed figures of drawing, wherein:

FIG. 1 is a general perspective view of the coil former of a multi-winding transformer of the type described herein, FIG. 2 is a perspective view of a cap adapted to be included in a transformer as shown in FIG. 1, FIG. 3 is a perspective view from bottom of the assembly comprised of the coil former of FIG. 1 having mounted thereon the cap of FIG. 2, FIG. 4 is an enlarged view of the portion of FIG. 3 indicated by the arrow IV, FIG. 5 is cross sectional view essentially along line V-V of FIG. 4, FIG. 6 is another perspective view from bottom of the assembly comprised of the coil former of FIG. 1 having mounted thereon the cap of FIG. 2, and FIG. 7 is an enlarged view of the portion of FIG. 1 indicated by the arrow VII.

Figure 8:
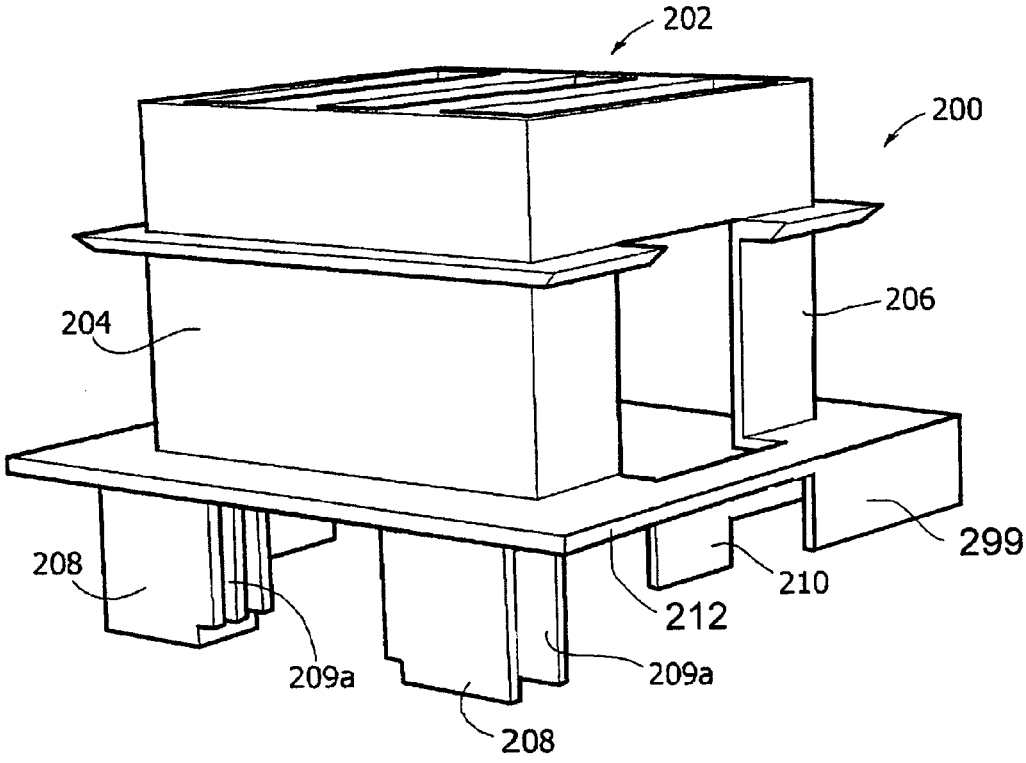

FIG. 8 is a perspective view of an alternative realisation of a cap as shown in FIG. 2 adapted to be included in a transformer as shown in FIG. 1,

DETAILED DESCRIPTION OF AN EXEMPLARY EMBODIMENT OF THE INVENTION

The exemplary embodiment of a transformer described herein has the basic feature of including a single coil former generally indicated as 100. The designation "coil former" is primarily intended to highlight the role this element plays in providing winding chambers for respective windings ("coils") of the transformer.

Throughout the annexed figures of drawing, the coil former 100 is shown without expressly illustrating the windings wound thereon. The outer contours of these windings are however shown in phantom lines in FIG. 1.

These include a primary winding P wound on the central part of the coil former 100, and a pair of secondary windings comprised of two windings S1 and S2 wound on the coil former 100 laterally of the primary winding P.

The two secondary, lateral windings S1 and S2 are connected in series or in parallel depending on the requirements of the circuit. While a transformer including three windings is described herein by way of example, those of skill in the art will promptly appreciate that the arrangement described herein may be extended to include also e.g. two or four windings or more, that is any plural number of windings.

The coil former 100 is essentially comprised of a tubular body 102, typically of a rectangular cross section, of an electrically insulating material of any type currently used to produce bobbins for transformers and having a thickness complying with safety insulation standards. Plastic moulded materials (such as e.g. Polyamide, Polycarbonate, or Polybutylene-Terephtalate) with a resistivity of at least $3*10^9$ Ohm*cm are exemplary of such a material. The windings P, S1, and S2 are comprised of electrically conductive wire such as e.g. copper wire either or the single wire type or of the braided (i.e. Litz wire) type.

In the final transformer assembly the windings P, S1, and S2 wound on the core former 100 are arranged side-by-side on a common core. This is typically comprised of one of the legs (usually the main, central leg) of a ferromagnetic (e.g. ferrite) core C.

The individual windings are confined axially by insulating flanges 104, 106 constituting integral parts of the coil former.

Specifically the insulating flanges in question include:

- two "outer" insulating flanges 104 that define the distal sides of the winding spaces where the two secondary windings S1 and S2 are wound, and
- two "inner" insulating flanges 106 that, on the one hand, define the proximal sides of the winding spaces where the two secondary windings S1 and S2 are wound and, on the other hand, define between them the winding space where the primary winding P is wound.

The two inner insulating flanges 106 thus separate (i.e. create the required creepage distances and thickness) the primary winding with respect to the secondary windings S1 and S2. As better detailed in the following, the two inner insulating flanges 106 are provided with a groove 106*a* to give rise to a labyrinth coupling with mating flanges provided in the cap 200 described below.

FIG. 1 further shows that the coil former also includes two end pin supporting rails 108 from which the two outer insulating flanges 104 extend upwardly. As better appreciated in the bottom view of FIG. 3, the pin supporting rails 108 are essentially co-extensive with one of the major walls of the tubular core of the coil former. Similarly, the two inner flanges 106 extend only marginally below said major wall, which is intended to face the printed circuit board (PCB—not shown) onto which the transformer is mounted.

The coil former 100 is intended to be coupled with a cover cap designated 200 as a whole. The protective cap 200 comprises an insulating material and is coupled with the coil former 100 in order to at least partially cover the windings P, S1, and S2. The cover cap 200 includes a top wall 202 that, in the exemplary embodiment shown, is a partial (i.e. apertured) top wall. The cap 200 also includes lateral walls (see the walls 204, 206 of FIG. 2) and is adapted to be coupled with the coil former 100 as schematically shown in FIG. 3.

After the final assembly of the transformer, the various elements described form sufficient wall thickness, creepage and clearance distances to ensure proper insulation of the windings P, S1, and S2.

Specifically, the tubular core 102 of the coil former 100 (essentially in the form of a hollow spindle) will provide the insulation between the individual coils of the windings P, S1, and S2 and the core ferromagnetic core C.

The inner insulating flanges 106, together with homologous matching flanges (not shown) protruding from the inner surface of the cap 200 and adapted to engage the grooves 106*a* to form a labyrinth arrangement therebetween, will ensure lateral insulation between the primary winding P and the lateral windings S1 and S2.

The outer insulating flanges 104, plus the lateral walls (e.g. 206) and the top wall 202 of the cap 200 will generally provide insulation of the windings P, S1, and S2 to the surrounding space. This is essentially achieved by having the sum of their thicknesses reach a value greater or equal to the value required from the insulation standard In order to minimize the overall dimensions of the transformer, and especially the "height" thereof, the lower side of the coils/windings P, S1, and S2 near the common circuit supporting substrate (PCB)—in other words the bench side of the coils—stands significantly closer to the circuit substrate than e.g. half the maximum required creepage without protruding completely to and through the circuit support.

This is thanks to the provision of lower flange walls in the cap 200 such as the insulating extensions 208 and 210 shown in FIG. 2. These insulating walls extend downwardly from a lateral horizontal skirt wall 212 extending radially from the lateral walls 204, 206 of the cap 200.

When the coil former 100 and the cap 200 are assembled (see e.g. FIG. 3) the skirt wall 212 of the cap abuts against the pin supporting rails 108 of the coil former 100. Moreover the skirt wall 212 permits to create the right creepage and clearance distances between the primary and/or secondary wires (e.g. the pins) and the ferrite.

In these conditions, the insulating extensions 208, that are located on one side of the cap 200, penetrate in between the pairs of inner and outer insulating flanges 106, 104 arranged at each side of the primary winding P. The insulating extensions 208 thus form, in the space below the skirt wall 212, two bridge-like barriers that insulate to the outside the winding spaces where the secondary windings S1 and S2 are arranged.

The insulating extensions 210, which are located on the other side of the cap 200, penetrate into the grooves 106*a* provided in the inner insulating flanges 106. The extensions 210 thus form in the space below the skirt wall 212 two extensions of the flanges 106 that insulate the winding space of the primary winding P with respect to the winding spaces where the secondary windings S1 and S2 are arranged.

The extensions 208 and 210 extend essentially in the direction of the "bench" or PCB where the transformer is mounted to provide the sufficient creepage and clearance distances between the neighbouring winding chambers for the windings P, S1, and S2.

The protective cap 200 has thus two extensions 210 cooperating with the two insulating flanges 106 to provide insulation between the first winding P and the two seconds windings S1, S2, wherein the two extensions 210 are placed opposite with respect to the insulating wall 208. The insulating wall 208 extends from the skirt wall 212 away from the windings P, S1, and S2.

A basic advantage of the arrangement illustrated in the drawing lies in that the three windings or coils P, S1, and S2 can be wound on the one-piece coil former 100, thus producing three windings that are already assembled.

In order to permit proper wiring of the transformer the ends or terminals of the wires comprising the three windings P, S1, and S2 must be preferably accessible at the lateral sides of the coil-former 100. Similarly, these terminals cannot be arranged in correspondence with the two inner flanges 106: the space to be provided for clamping the wires would in fact be obtrusive to the wire winding process over (i.e. around) the coil former 100.

For that reason, in the arrangement described herein the two ends, designated P1 and P2 (see FIGS. 3 and 4), of the central primary winding P are extended through two notches 106*b* provided in the inner flanges 106 below the skirt wall 212 and caused to pass across the winding spaces for the secondary windings S1 and S2 to reach respective fixing formations (e.g. holes) 109 provided in the pin supporting rails 108 of the coil former 100 where the terminals of the windings will be fixed. This arrangement of parts can be easily obtained when the windings are wound on the coil former.

However, the paths of extension the two ends, P1 and P2 of the central primary winding P are selected in order that, once the cap 200 is coupled to the coil former 100, these paths will lie on the opposite (outer) sides of the insulating, bridge-like extensions 208 with respect to the secondary windings S1 and S2.

In that way the distance through insulation between the primary winding P and the secondary windings S1 and S2 will be easily reduced down to the value, which is required by the standard SELV norms.

When the cap 200 is coupled to the coil former 100 the path toward the bottom side, schematically indicated by the arrow PF in FIG. 4, may be easily rendered longer than e.g. 6 mm because the extensions 208 of the cap 200 together with the coil-former can extend through the PC-board (or any similar support) onto which the transformer is mounted.

FIG. 5 is essentially a horizontal cross sectional view across one of the extensions 208 inserted into the coil former 100 at approximately mid-length of its extension. FIG. 5 (and FIGS. 1, 2, and 7 as well) show that the sides of each extension 208 and those portions of the coil former 100 (essentially the flanges 104 and 106) between which the extension 208 is inserted are provided with grooved formations 209*a*, 209*b* (i.e. surface sculpturing) giving rise to further labyrinth arrangements; these labyrinth arrangements create two notional lateral creepage paths, designated PF2, which can be easily made longer than the required value of 6 mm. This even if the thickness of the flanges (and especially of the inner flanges 106) were smaller than this value.

FIG. 6 shows the arrangement of parts at the opposite side of the coil former 100, where notches 112 for the ends (not shown) of the secondary windings S1 and S2 are provided in the pin supporting rails 108 of the coil former 100. There, the two inner flanges 106 of the coil former 100 are continued "outwardly" by the extensions 210 of the flanges of the cap that engage the grooves 106*a* of the two inner flanges 106 of the coil former 100. These, together with the low portion of the walls of the coil former, namely those portions of the flanges 106 intended to be inserted in the supporting PC board again create distances, between the primary winding P and the two secondary windings S1 and S2 that are longer than 6 mm.

The arrangement just described ensures—over the whole transformer structure—the desired insulation (e.g. in compliance with SELV requirements) between the primary and secondary sides.

Consequently, without prejudice to the underlying principles of the invention, the details and embodiments may vary, even significantly, with respect to what has been described and shown, by way of example only, without departing from the scope of the invention, as defined by the annexed claims. Exemplary of such possible variants are i.a.:

- the transformer including a plural number of windings different from three,
- the primary and secondary windings having their roles exchanged with respect to the exemplary arrangement shown herein,
- any of the flanges 104 or 106 being formed as a part of the cap 200 rather than as a part of the coil former 100, and
- the insulating walls here formed by the extensions 208 and/or 210 of the cap 200 being provided as parts of the coil former.

FIG. 8 shows a perspective view of an alternative realisation of a cap as shown in FIG. 2. Compared to the cap as shown in FIG. 2 the cap in FIG. 8 has a modified skirt wall 212. The skirt wall 212 in FIG. 8 is bordered by a border strips 299 in the area of the terminals of the secondary windings. In FIG. 8 only one border strip 299 is observable. A second border strip 299 can be located at the other secondary winding. Advantageously the border strips 299 insulate the terminals of the secondary windings against neighbouring components on the printed circuit board. The border strips 299 may only cover an upper part of the secondary windings or may reach down to the printed circuit board.

The invention claimed is:

1. A transformer including:

a coil former comprising:

a plurality of windings wound on the coil former, at least one first insulating flange separating a first winding of said plurality of windings from at least one second winding of said plurality of windings, at least one second insulating flange defining together with said at least one first insulating flange a winding space for said at least one second winding, wherein said first winding has at least one end extending across said winding space for said at least one second winding, wherein said at least one first insulating flange is an integral part of said coil former, and a protective cap comprising:

an insulating material, lateral walls, a skirt wall extending outwardly of said lateral walls, an insulating wall extending downwardly from the skirt wall and extending radially from the lateral walls, said insulating wall is an integral part of said cap, wherein the protective cap is coupled with said coil former after the winding to at least partially cover said plurality of windings, and said protective cap having at least one extension cooperating with said at least one first insulating flange to provide insulation between said first winding and said at least one second winding opposite said insulating wall, said insulating wall extending between said at least one end of said first winding extending across said winding space for said at least one second winding and said at least one second winding to provide insulation therebetween.

2. The transformer of claim 1, wherein said coil former includes a single body having said plurality of windings wound thereon.

3. The transformer of claim 1, wherein said at least one first insulating flange and said at least one second insulating flange are integral parts of said coil former.

4. The transformer of claim 1, wherein said protective cap has an apertured top wall.

5. The transformer of claim 1, wherein said skirt wall abuts against said coil former.

6. The transformer of claim 1, wherein wherein said skirt wall extends radially from the lateral walls, and wherein said insulating wall extends from said skirt wall away from said plurality of windings.

7. The transformer of claim 1, wherein said insulating wall is provided with sculpturing forming a labyrinthine path with said coil former.

8. The transformer of claim 1, wherein said lateral walls surround said plurality of windings and said skirt wall extends outwardly of said lateral walls, said skirt wall abutting against said coil former and in that said at least one extension cooperating with said at least one first insulating flange extends from said skirt wall away from said plurality of windings.

9. The transformer of claim 1, wherein said at least one extension and said at least one first insulating flange jointly form a labyrinthine path.

10. The transformer of claim 1, wherein it includes:

said first winding interposed between a pair of said second windings, a pair of said first insulating flanges each separating said first winding from a respective one of said pair of second windings, a pair of said second insulating flanges each defining together with a respective one of said first insulating flanges a respective winding space for one of said second windings of said pair of said second windings, wherein said first winding has two ends each extending across the respective winding space for one of said second windings, and a pair of said insulating walls each extending between one of said two ends of said first winding and one of said second windings to provide insulation therebetween.

11. The transformer of claim 1, wherein said protective cap has a pair of said extensions each cooperating with a respective one of said pair of first insulating flanges to provide insulation between said first winding and a respective one of said pair of second windings opposite said pair of said insulating walls.

12. The transformer of claim 2, wherein said at least one first insulating flange and said at least one second insulating flange are integral parts of said coil former.

13. The transformer of claim 4, wherein said protective cap includes an extension, the extension being said insulating wall.

14. The transformer of claim 5, wherein said insulating wall is provided with sculpturing forming a labyrinthine path with said coil former.

15. The transformer of claim 6, wherein said insulating wall is provided with sculpturing forming a labyrinthine path with said coil former.

16. The transformer of claim 8, wherein said at least one extension and said at least one first insulating flange jointly form a labyrinthine path.

* * * * *